US006091926A

United States Patent [19]

Yamada

[11] Patent Number: 6,091,926

[45] Date of Patent: Jul. 18, 2000

[54] FIXING DEVICE USING A BELT FOR AN IMAGE FORMING APPARATUS

[75] Inventor: Masamichi Yamada, Kanagawa, Japan

[73] Assignee: Ricoh Company, Ltd., Tokyo, Japan

[21] Appl. No.: 09/277,222

[22] Filed: Mar. 26, 1999

[30] Foreign Application Priority Data

Mar. 27, 1998 [JP] Japan ..... 10-081693

[51] Int. Cl.[7] ..... G03G 15/20

[52] U.S. Cl. ..... 399/329; 399/75; 399/333

[58] Field of Search ..... 399/75, 320, 324, 399/328, 329, 333; 219/216; 347/156; 430/97, 124

[56] References Cited

U.S. PATENT DOCUMENTS

| | | | |
|---|---|---|---|
| 4,598,990 | 7/1986 | Kusumoto et al. | 399/75 |
| 5,471,288 | 11/1995 | Ohtsuka et al. | 399/324 X |
| 5,581,340 | 12/1996 | Hayashi et al. | 399/328 |
| 5,666,623 | 9/1997 | Yamada et al. | 399/320 |
| 5,697,036 | 12/1997 | Moser | 399/329 |
| 5,890,047 | 3/1999 | Moser | 399/329 |
| 5,918,098 | 6/1999 | Van Bennekom | 399/333 |
| 5,926,680 | 7/1999 | Yamamoto et al. | 399/328 |

FOREIGN PATENT DOCUMENTS

| | | |
|---|---|---|
| 5-080666 | 4/1993 | Japan . |
| 8-286535 | 11/1996 | Japan . |

*Primary Examiner*—Sandra Brase
*Assistant Examiner*—Sophia S. Chen
*Attorney, Agent, or Firm*—Oblon, Spivak, McClelland, Maier & Neustadt, P.C.

[57] ABSTRACT

A fixing device for fixing a toner image formed on a recording medium includes an endless belt passed over a plurality of rollers. A press roller is pressed against a portion of the belt passed over a fix roller, which is one of the plurality of rollers. A heat source applies heat to the toner image carried on the recording medium being conveyed via a nip where the belt and press roller are pressed against each other. The nip has a width greater than 25° inclusive in terms of a circumferential angle as seen from the axis of the fix roller. The fixing device prevents a recording medium from wrapping around the belt and broadens a parting temperature range.

31 Claims, 9 Drawing Sheets

FIXING DEVICE USING A BELT FOR AN IMAGE FORMING APPARATUS

BACKGROUND OF THE INVENTION

The present invention relates to an electrophotographic copier, facsimile apparatus, printer or similar image forming apparatus. More particularly, the present invention relates to a fixing device for fixing a toner image on a recording medium by conveying the medium via a nip where a fix roller over which the belt is passed and a press roller are pressed against each other.

It is a common practice with an electrophotographic image forming apparatus to cause a scanner to read a document image and then and cause an image forming section to electrostatically form a latent image representative of the document image on a photoconductive element or similar image carrier by exposure. The latent image is developed to form a corresponding toner image. The toner image is transferred from the drum to a paper or similar recording medium and then fixed on the paper. The paper with the fixed toner image is driven out of the apparatus.

A predominant type of fixing device for the above application uses a heat roller having a heat source thereinside and a press roller pressed against the heat roller. While the heat roller and press roller are rotated while forming a nip therebetween, they fix a toner image formed on a paper being conveyed via the nip by heat and pressure. The prerequisite with this type of fixing device is that an elastic layer covering the surface of the fix roller be thin enough to prevent a warm-up time from increasing. However, the limited thickness of the elastic layer limits the available width of the nip and therefore a parting temperature range insuring desirable fixation. The parting temperature range refers to a range between a cold offset condition and a hot offset condition. In the cold offset condition, the fixing temperature is so low, toner adheres to the fix roller and belt or cannot be sufficiently fixed on the paper. In the hot offset condition, the fixing temperature is so high, adhesion acting between toner particles is weakened and causes the toner to again adhere to the fix roller and belt.

Japanese Patent Laid-Open Publication No. 8-339133, for example, teaches a fixing device using a belt and locating a heat source outside of a fix roller in order to reduce the warm-up time. Specifically, the belt has a preselected area and is heated in order to scatter the time and place for heating toner carried on a recording medium. With this scheme, it is possible to select a relatively low fixing temperature and therefore to reduce the warmup time as well as required energy. The fixing device taught in the above document is also usable as means or a device of the type heating a recording medium, e.g., a device installed in a copier, laser beam printer (LBP), electrostatic printer or similar image forming apparatus for fixing a toner image on a recording medium by heat and pressure or a device for heating a recording medium carrying an image in order to regenerate its surface property.

However, the above conventional fixing device has some problems left unsolved, as will be described specifically later.

SUMMARY OF THE INVENTION

It is therefore an object of the present invention to provide a fixing device capable of preventing a recording medium from wrapping around a belt and broadening the parting temperature range.

It is another object of the present invention to provide a fixing device capable of preventing a recording medium from wrapping around a belt and obviating toner offset.

It is another object of the present invention to provide a fixing device facilitating the formation of a small round shape at a position just downstream of a nip where a fix roller and a belt contact each other, thereby broadening the parting temperature range, preventing a recording medium from wrapping around the belt, and reducing a required drive torque.

It is another object of the present invention to provide a fixing device locating a heat source outside of a fix roller and reducing the warm-up time.

It is another object of the present invention to provide a fixing device causing a press roller and a fix roller to form a downward nip and thereby preventing a recording medium from wrapping around a belt.

It is another object of the present invention to provide a fixing device including a press roller covered with PFA (tetrafluoroethylene-perfluoroalkylvinylether copolymer) or similar material having a high parting ability, thereby preventing a recording medium from wrapping around the press roller.

It is still another object of the present invention to provide a fixing device including a fix roller, which drives a belt for stabilizing the conveyance of a recording medium.

It is yet another object of the present invention to provide a fixing device driving both of a fix roller and a press roller to thereby free a belt and the fix roller from deterioration ascribable to friction between them and the press roller, and preventing a recording medium from creasing or otherwise deforming due to a difference in peripheral speed between the belt and the press roller.

It is further object of the present invention to provide a fixing device driving a press roller in order to reduce irregularity in linear velocity for conveying a recording medium.

It is an additional object of the present invention to provide a fixing device driving both of a press roller and a fix roller to thereby free a belt and the fix roller from deterioration ascribable to friction between them and the press roller, and preventing a recording medium from creasing or otherwise deforming due to due to a difference in peripheral speed between the belt and the press roller.

A fixing device for fixing a toner image formed on a recording medium of the present invention includes an endless belt passed over a plurality of rollers. A press roller is pressed against a portion of the belt passed over a fix roller, which is one of the plurality of rollers. A heat source applies heat to the toner image carried on the recording medium being conveyed via a nip where the belt and press roller are pressed against each other. The nip has a width greater than 25° inclusive in terms of a circumferential angle as seen from the axis of the fix roller.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
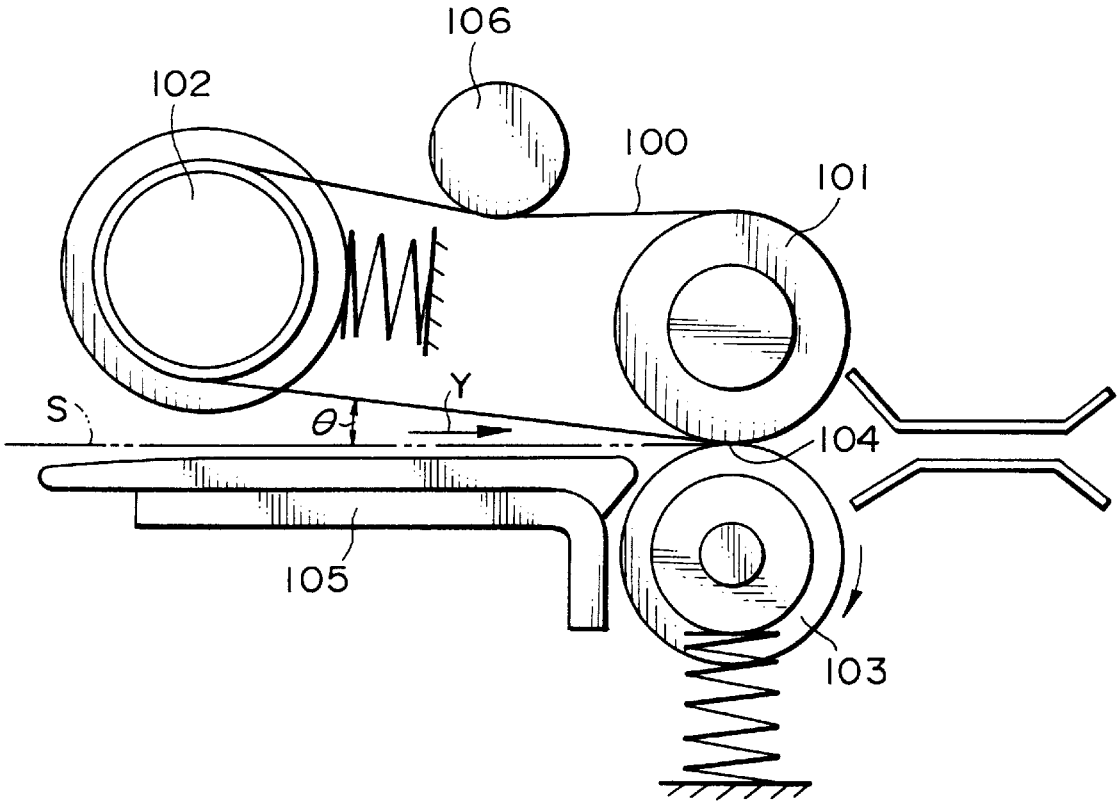
FIG. 1 PRIOR ART
FIG. 1 is a side elevation showing a conventional fixing device including a belt.

To better understand the present invention, brief reference will be made to a conventional fixing device using a belt, shown in FIG. 1. The fixing device to be described is taught in Laid-Open Publication No. 8-339133 mentioned earlier. As shown, the fixing device includes an endless belt 100 passed over a fix roller 101 and a heat roller 102. A press roller 103 is pressed against the fix roller 101 via the belt 100. A recording medium in the form of a sheet S is conveyed in a direction Y. A guide 105 is positioned upstream of a nip 104 between the belt 100 and the press roller 103 in the direction Y. While the fix roller 101 causes the belt 100 to rotate, the belt 100 causes the heat roller 102 and press roller 103 to rotate. First, the heat roller 102 heats the portion of the belt 100 passed thereover. The heated portion of the belt 100 heats a toner image formed on the sheet S being conveyed along the guide 105, thereby softening the toner image beforehand. The toner image is fixed on the sheet S when the sheet S is passed through the nip 104 between the belt 100 and the press roller 103.

A roller 106 is held in contact with the belt 100 by a spring not shown. The roller 106 plays the role of cleaning means for removing paper dust, toner and so forth from the belt 100 or the role of an applicator for applying silicone oil or similar parting agent to the belt 100. The parting agent reduces the transfer of toner from the sheet S to the belt 100, i.e., so-called offset.

In the above construction, the angle θ between the sheet S entering the nip 104 and the belt 100 is selected to be small enough to broaden the parting temperature range by using the remaining heat. This, however, cannot sufficiently broaden the parting temperature range because the toner image on the sheet S is apt to rub itself against the belt 100 before reaching the nip 104, depending on the kind of the sheet S. Further, if the nip 104 does not have a width greater than a certain width, the sheet S is likely to wrap around the belt 100. To make up for the limited parting temperature range, the roller 106 applies the parting agent (oil) to the belt 100. This brings about another problem that the parting agent is left on the sheet S after fixation and smears the operator's hands. Moreover, the parting agent causes the fixed image to be partly lost when irregularly applied to the belt 100. In addition, a tank storing the parting agent is necessary and makes it difficult for the user to maintain the apparatus.

Figure 2:
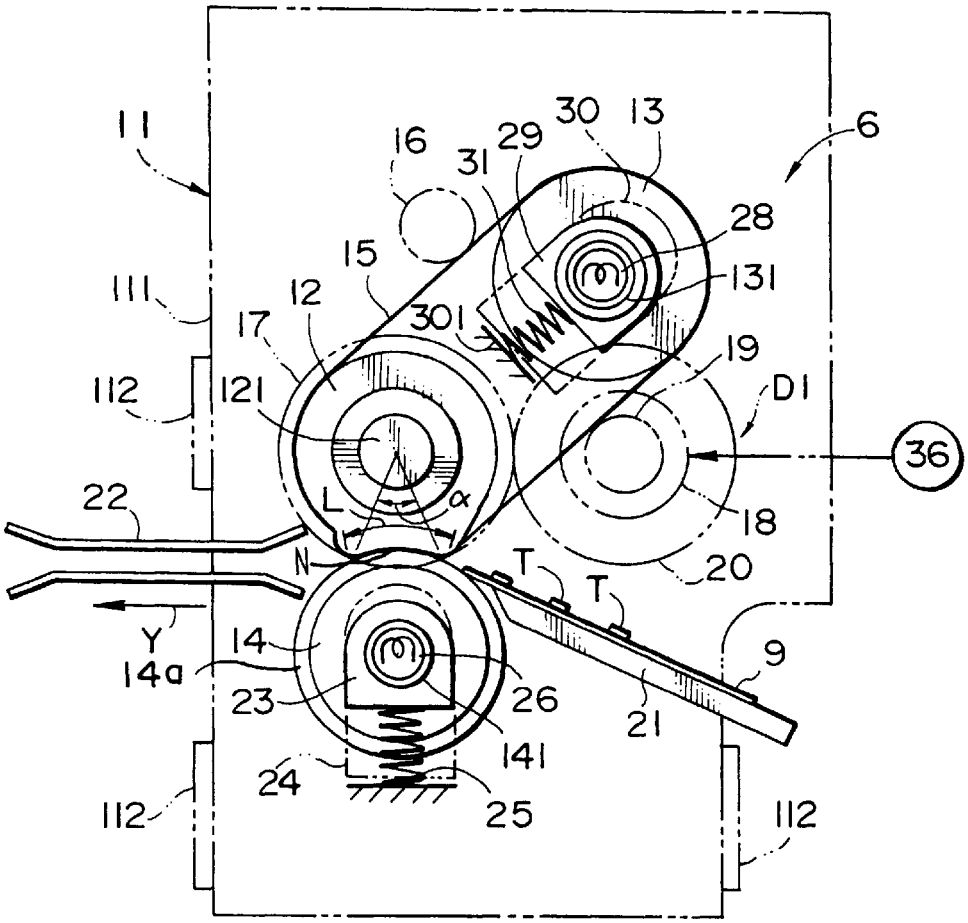
FIG. 2 is a side elevation showing a fixing device including a belt embodying the present invention.

Referring to FIG. 2, a fixing apparatus using a belt embodying the present invention will be described. The fixing device is arranged in the image forming section of a color copier by way of example. Generally, the color copier, not shown, includes a scanner for reading an image out of a document. The image forming section forms a toner image corresponding to the image read by the scanner and transfers the toner image to a sheet fed from a sheet feed section. After the toner image has been fixed on the sheet, the sheet is driven out of the copier to a tray.

Figure 3:
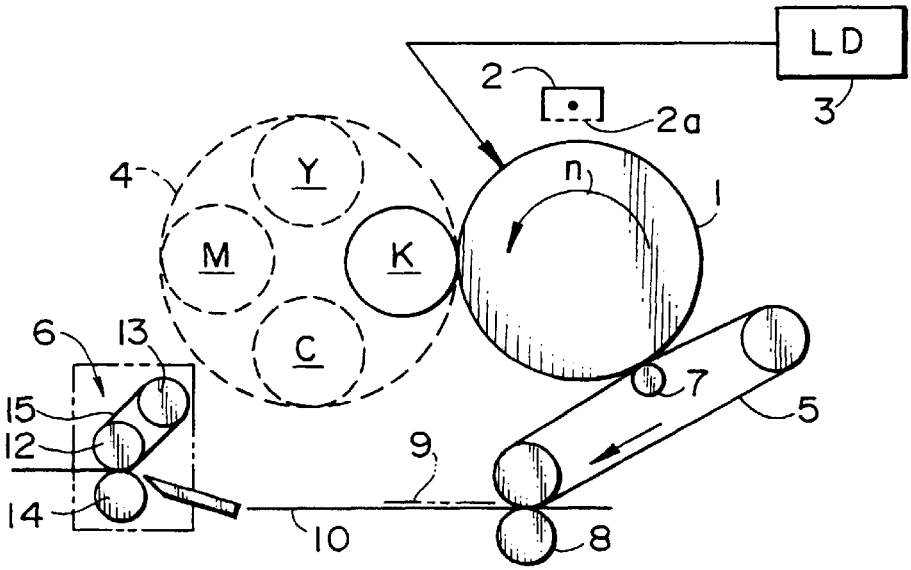
FIG. 3 is view showing the general construction of an image forming section included in an electrophotographic copier to which the illustrative embodiment is applied.

Specifically, as shown in FIG. 3, the image forming section includes a photoconductive drum or image carrier 1 made up of an aluminum base and a photoconductive layer formed on the base. Drive means, not shown, causes the drum 1 to rotate in a direction n at a linear velocity matching with a preselected mode. A charger 2, a laser diode (LD) 3, a developing unit 4, a transfer belt 5 and a fixing device 6, as well as a cleaning device and a discharging device not shown, are sequentially arranged around the drum 1 in this order. The charger 2 deposits on the drum 1 a charge which is variable in accordance with a potential applied to a grid 2*a*. The LD 3 issues a laser beam in accordance with image data output from the scanner. As a result, a latent image representative of the image read by the scanner is electrostatically formed on the photoconductive layer of the drum 1. The developing unit 4, implemented as a revolver by way of example, includes four developer tanks respectively storing a yellow (Y) developer, a magenta (M) developer, a cyan (C) developer, and a black (K) developer. Each developer tank has a respective developing sleeve, not shown, thereinside. A bias for development is applied to the developing sleeve. The developer tanks each develop a particular latent image formed on the drum 1 by depositing the respective toner on the latent image, thereby forming a toner image.

The toner image formed on the drum 1 is transferred to the transfer belt 5 (primary transfer). At this instant, an adequate bias is applied to a primary transfer roller 7 in order to adequately control the amount of image transfer. The above procedure including charging, exposure, development and image transfer is repeated with each of the K, C, M and Y developers. Consequently, a composite four-color toner image is formed on the transfer belt 5. A secondary transfer roller 8 is applied with an adequate bias for transferring the toner image from the transfer belt 5 to a sheet 9 (secondary transfer). The sheet 9 with the toner image is conveyed to the fixing device 6 along a guide 10. After the toner image has been fixed on the sheet 9 by the fixing device 6, the sheet 9 is driven out to a tray not shown. The sheet 9 may be a paper or similar recording medium in the form of a sheet.

The fixing device 6 will be described specifically with reference to FIGS. 2 and 4. As shown, the fixing device 6 includes a frame 11 affixed to a framework, not shown, included in the copier. A fix roller 12, a heat roller 13, a belt 15 and a roller 16 are mounted on the frame 11. The belt 15 is passed over the fix roller 12 and heat roller 13. The roller 16 applies silicone oil, or parting agent for reducing offset, to the outer surface of the belt 15.

Figure 4:
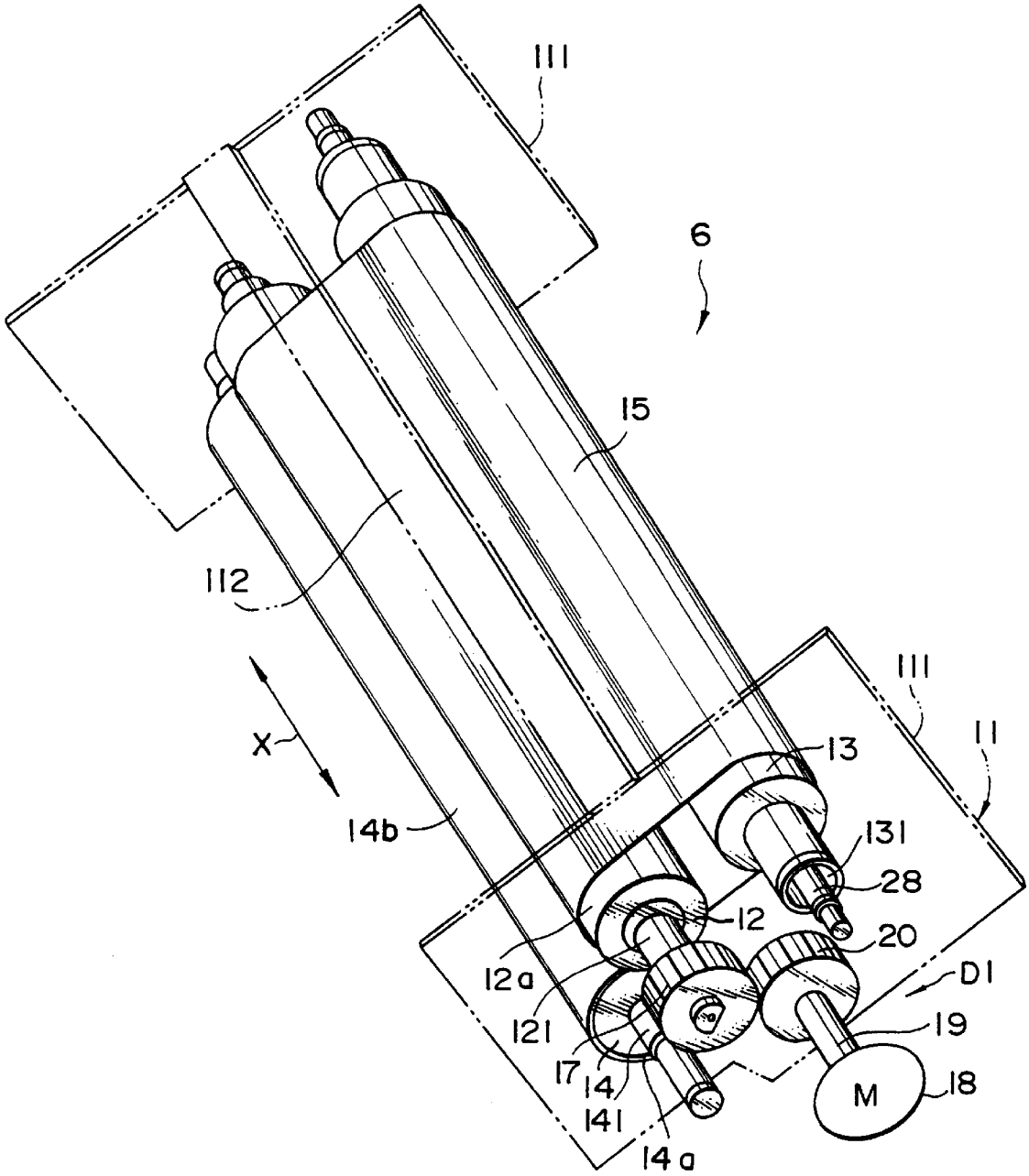
FIG. 4 is a fragmentary perspective view of the illustrative embodiment.

The frame 11 has a rectangular configuration elongate in the direction perpendicular to the sheet surface of FIG. 2, i.e., a direction indicated by a double-headed arrow X in FIG. 4. The frame 11 includes a pair of end plates 111 facing each other in the right-and-left direction, as indicated by dash-and-dots lines in FIG. 4. The end plates 111 are connected together by a plurality of bars 112 (only one is shown in FIG. 4) extending in the direction X.

The belt 15 has a base implemented by a nickel film as thin as 100 μm. A 200 μm thick parting layer of silicone rubber is formed on the base for enhancing thermal response. The base may alternatively be formed of polyimide and may have a thickness ranging from 30 μm to 150 μm, considering the flexibility of the belt 15.

The fix roller 12 is mounted on a shaft 121 journal led to the end plates 111 at opposite ends thereof. The fix roller 12 has a metallic core covered with a heat insulating or heat resistant, porous elastic material having low thermal conductivity. In the illustrative embodiment, the elastic material is implemented by a sponge-like heat insulating material and has a thickness greater than 17% of the diameter of the fix roller 12 in order to facilitate the formation of a small round r-shape which will be described later. In addition, the sponge-like heat insulating material has hardness lower than 30° in terms of Ascar hardness for reducing the drive torque of the fix roller 12 while facilitating the formation of the above configuration also.

Figure 7:
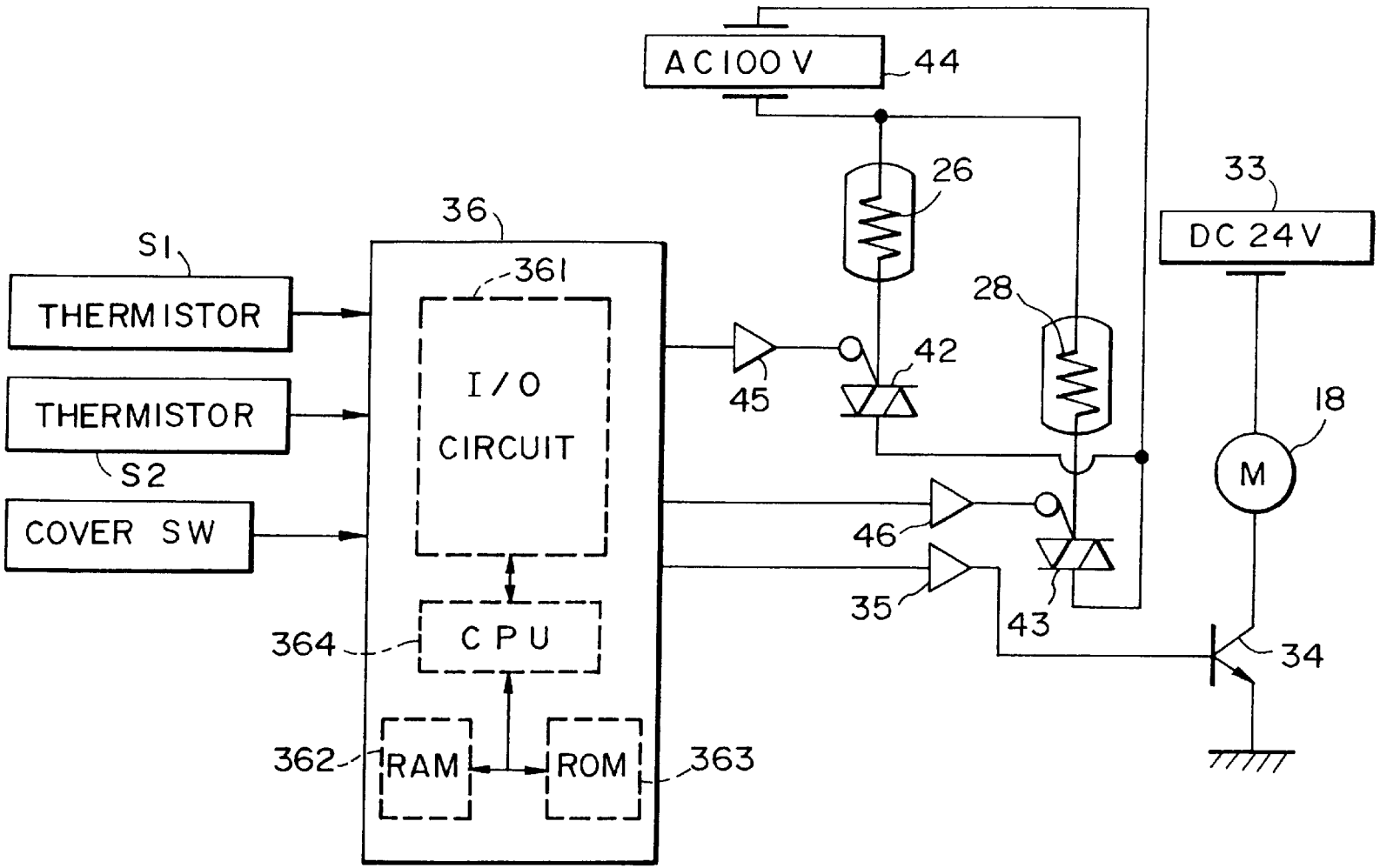
FIG. 7 is a block diagram schematically showing power supply circuitry included in the illustrative embodiment.

A roller driveline D1 is connected to an input gear 17 mounted on one end of the shaft 121 of the fix roller 12. The roller driveline D1 includes, in addition to the input gear 17, a drive gear 20 held in mesh with the gear 17 and a motor 18. The motor 18 is drivably connected to a drive shaft 19 protruding from the drive gear 20. A part of the drive shaft 19 is rotatably supported by the end plate 111 via a bearing not shown. The motor 18 is mounted on a bracket, not shown, extending out from the end plate 111. The rotation of the motor 18 is transmitted to the fix roller 12 via the drive gear 20 and input gear 17, so that the fix roller causes the belt 15 to rotate. The belt 15, in turn, causes the heat roller 13 and press roller 14 to rotate. As shown in FIG. 7, the motor 18 is connected at one end to a DC power supply 33 and at the other end to a controller or control means 36 via a switching transistor 34 and a motor driver 35. The controller 36 selectively turns on or turns off the motor 18.

Figure 6A:
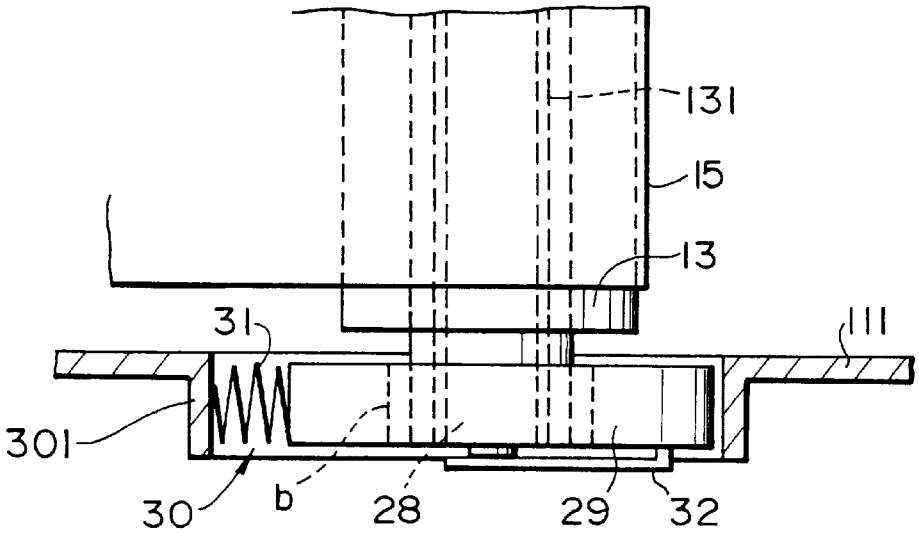
FIGS. 6A and 6B are sections respectively showing one end portion of a heat roller also included in the illustrative embodiment and one end portion of the press roller.
Figure 6B:
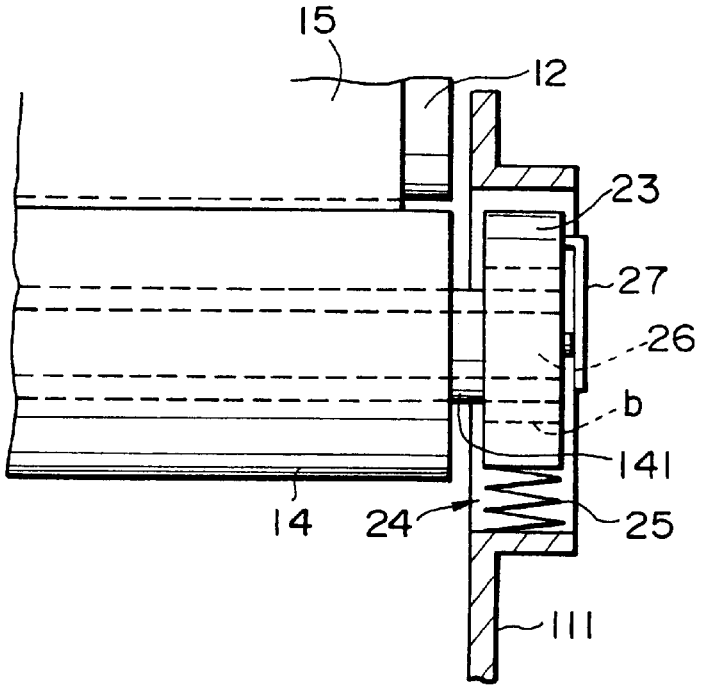

As shown in FIG. 6B, the press roller 14 is mounted on a shaft 141. Opposite ends of the shaft 141 (only one end is shown) each are rotatably supported by a slider 23 via a bearing b. The slider 23 is slidably received in a guide slot 24 formed in the end plate 111 and elongate in the up-and-down direction. A compression spring 25 constantly biases the slider 23 upward. The bias of the compress ion spring 25 acts on the belt 15 and fix roller 12 via the slider 23 and press roller 14, so that a toner image can be fixed on the sheet 9 by heat and pressure. A heater 26 is disposed in the shaft 141 and supported by a bracket 27 extending out from the slider 23. A thermistor S1 (see FIG. 7) adjoins the press roller 14 for sensing the temperature of the roller 14. The controller 36 controls, based on the output of the thermistor S1, the heater 26 via a triac 42 and a heater driver 45 such that the temperature of the press roller 14 converges to a preselected temperature.

The press roller 14 is implemented by an aluminum pipe having relatively great wall thickness, rigidity, and thermal conductivity. An elastic layer 14*a* covering the press roller 14 is less than 2 mm thick inclusive and formed of a material capable of maintaining hardness higher than 40° inclusive in accordance with JISA (Japanese Industrial Standards, scale A).

As shown in FIG. 2, when the press roller 14 having the above configuration is pressed against the fix roller 12 via the belt 15, it forms an upwardly convex nip N having a preselected width L in a direction Y in which the sheet 9 is conveyed. A toner image is fixed on the sheet 9 at the nip N. The sheet 9 with the fixed toner image is smoothly driven out of the copier without wrapping around the belt 15. The nip width L may be represented by a circumferential angle α of the fix roller 12. In the illustrative embodiment, the compression spring 25 mentioned earlier adjusts the pressure of the press roller 14 acting on the belt 15 such that the angle α is greater than 25° inclusive. Also, the materials forming the various members are so selected as to implement such an angle.

The surface of the press roller 14 is covered with PFA, PTFE, FEP or similar material 14*b* having a high parting ability. This prevents the sheet 9 from wrapping around the press roller 14 and prevents the toner from melting and adhering to the belt 15. The roller 16 is supported by roller supporting means, not shown, and elastically pressed against the outer surface of the belt 15 at a preselected position. The roller 16 applies an extremely small amount of parting agent (oil) to the outer surface of the belt 15, also preventing the paper 9 and toner from adhering to the belt 15. If desired, the roller 16 and an oil tank, not shown, may be omitted in order to simplify the construction of the fixing device.

A guide 21 is positioned below the belt 15 and upstream of the nip N. The guide 21 guides the sheet 9 carrying a toner image T therewith to the nip N between the belt 15 and the press roller 14 while preventing it from contacting the belt 15. A guide 22 is positioned downstream of the nip N.

As shown in FIG. 2, the heat roller 13 has its opposite ends (only one end is shown in FIG. 6A) supported by sliders 29 via bearings b. Each slider 29 is slidably received in a guide slot 30 formed in the adjoining end plate 111 and extending obliquely upward. The end plate 111 is formed with a spring seat 301 supporting one end of a spring 31. The spring 31 constantly biases the slider 29 away from the fix roller 12 along the guide slot 30. In this condition, tension corresponding to the bias of the spring 31 acts on the belt 15 passed over the fix roller 12 and heat roller 13.

The heat roller 13 is implemented by an aluminum pipe having relatively high thermal conductivity. As shown in FIG. 6A, a heater 28 is disposed in the bore 131 of the heat roller 13 and supported by a bracket 32 extending out from the slider 29. A thermistor S2 (see FIG. 7) adjoins the belt portion of the heat roller 13 for sensing the temperature of the roller 13. The controller 36 controls, based on the output of the thermistor S2, the heater 28 via a triac 43 and a heater driver 46 such that the temperature of the belt 15 converges to a preselected temperature.

As shown in FIG. 7, the controller 36 includes an I/O (Input/Output) circuit 361 connected to the drivers 45 and 46, motor driver 35, and thermistors S1 and S2. A RAM (Random Access Memory) 362 allows various data to be written therein, as needed. A ROM (Read Only Memory) 363 stores various control programs for image formation and various fixed values. A CPU (Central Processing Unit) 364 serves as a control circuit. The controller 36 is implemented as a conventional microcomputer and controls the heaters 28 and 26 in accordance with a preselected heater control program. In addition, the controller 36 controls image formation via the motor driver 35 and motor drivers, not shown, included in the other image forming means.

The operation of the fixing device having the above construction will be described hereinafter. Assume that the image forming section shown in FIG. 3 executes the image forming process of the conventional color copier. On the turn-on of a main switch, not shown, the controller 36 controls various movable sections and the motor 18 and heaters 26 and 28 in matching relation to a warm-up mode, a standby mode, and a copy mode.

Specifically, the controller 36 selectively turns on or turns off the triacs 42 and 43 in accordance with the outputs of the thermistors S1 and S2, respectively, thereby controlling the flow of a current from an AG power supply 44. As a result, the heaters 26 and 28 each are selectively turned on or turned off in order to control the associated temperature to a target value. While the fixing device is in operation, the heat roller 13 constantly exerts a tensile force corresponding to the bias of the spring 31 on the belt 15 in order to reduce noise ascribable to the belt 15. At the same time, the roller 16 constantly applies silicone oil to the belt 15 in order to reduce the offset of toner.

The press roller 14 rotates in pressing contact with the belt 15 due to the action of the spring 25, forming the nip N greater than 25° inclusive in terms of the circumferential angle α of the fix roller 12. The toner image T on the sheet 9 is therefore fixed by heat and pressure while being conveyed via the nip N. Why the circumferential angle α is selected to be greater than 25° inclusive is as follows.

Figure 5:
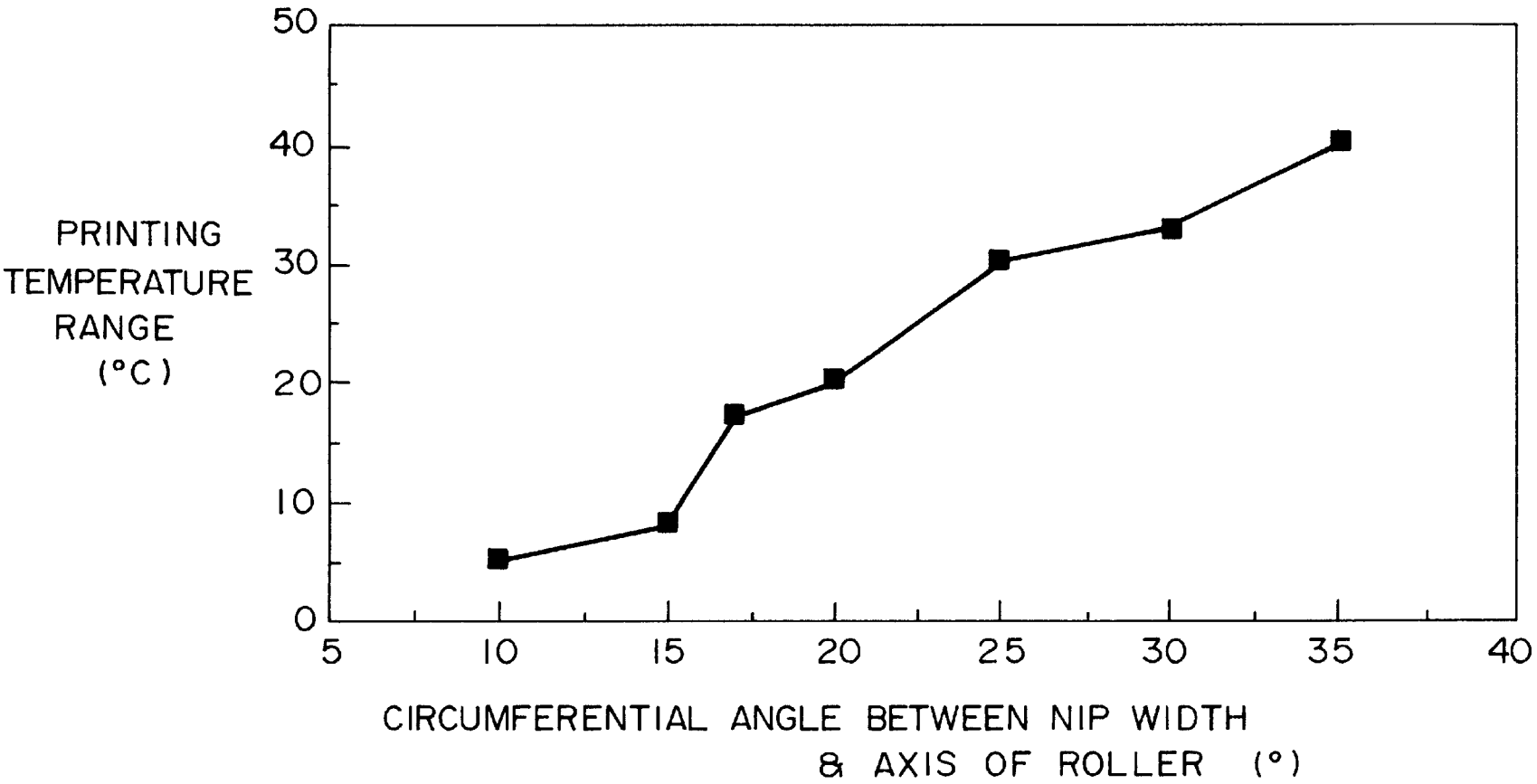
FIG. 5 is a graph showing a relation between the circumferential angle of a nip between a fix roller and a press roller included in the illustrative embodiment and the parting temperature range.

Presumably, the parting temperature range between the cold offset condition and the hot offset condition increases with an increase in the circumferential angle α of the nip N over which the fix roller 12 and press roller 14 contact each other. FIG. 5 shows a relation between the parting temperature range and the circumferential angle α determined by experiments. As shown, when the angle exceeds 25°, the parting temperature range sharply increases. This is considered to be a factor other than an increase in nip width. More specifically, as shown in FIG. 2, a small round r-shape is formed at a position just downstream, in the direction Y, of the position where the press roller 14 is pressed against the fix roller 12 and belt 15. The small round r-shape is more distant from the surface of the sheet 9 than at the other portions with respect to the angular displacement of the belt 15.

When the circumferential angle α greater than 25° is selected to implement the above small round r-shape, the sheet 9 is successfully prevented from following the displacement of the belt 15, i.e., wrapping around the belt 15. This surely obviates toner offset. Moreover, the broader parting temperature range allows an extremely small amount of parting agent to suffice. Such a small amount of parting agent would not remain on the sheet 9 after fixation or would not bring about the local omission of the toner image ascribable to irregular application.

If desired, the roller 16 for applying the parting agent and an oil tank, not shown, storing the parting agent may be omitted to render the fixing device oil-free. This is successful to promote the miniaturization of the fixing device and to allow the user to maintain the device.

As stated above, the fix roller 12 is covered with a sponge-like heat insulating material 12*a* whose thickness is more than 17% of the diameter of the fix roller 12. This, coupled with the circumferential angle α of the nip N grater than 25° inclusive, allows the small round r-shape to be easily and surely formed at the position just downstream of the nip N in the direction Y. In addition, the sponge-like heat insulating material serves to reduce a drive torque required of the motor 18 and therefore the size of the motor 18.

The heaters 26 and 28 are respectively disposed in the press roller 14 and heat roller 13. Therefore, despite that the surface layer 12*a* of the fix roller 12 has a thickness greater than 17% of the diameter of the roller 12 inclusive, the warmup time is prevented from increasing. Further, the surface layer 12*a* of the fix roller 12 suppresses the radiation of heat from the belt 15 toward the fix roller 12 and thereby reduces the warm-up time. Consequently, the wasteful drive of, e.g., the heater 28 is obviated.

Moreover, the sponge-like heat insulating material 12*a* covering the fix roller 12 has hardness of less than 30° inclusive in terms of Ascar hardness. This further facilitates the formation of the small round r-shape at the preselected position and further reduces the torque required to drive the fix roller 12 and the size of the motor.

Hereinafter will be described some different modifications of the driveline D1 in which the rotation of the motor 18 is directly applied to the fix roller 12 and causes the belt 15 and press roller 14 to follow the rotation of the fix roller 12.

Figure 8:
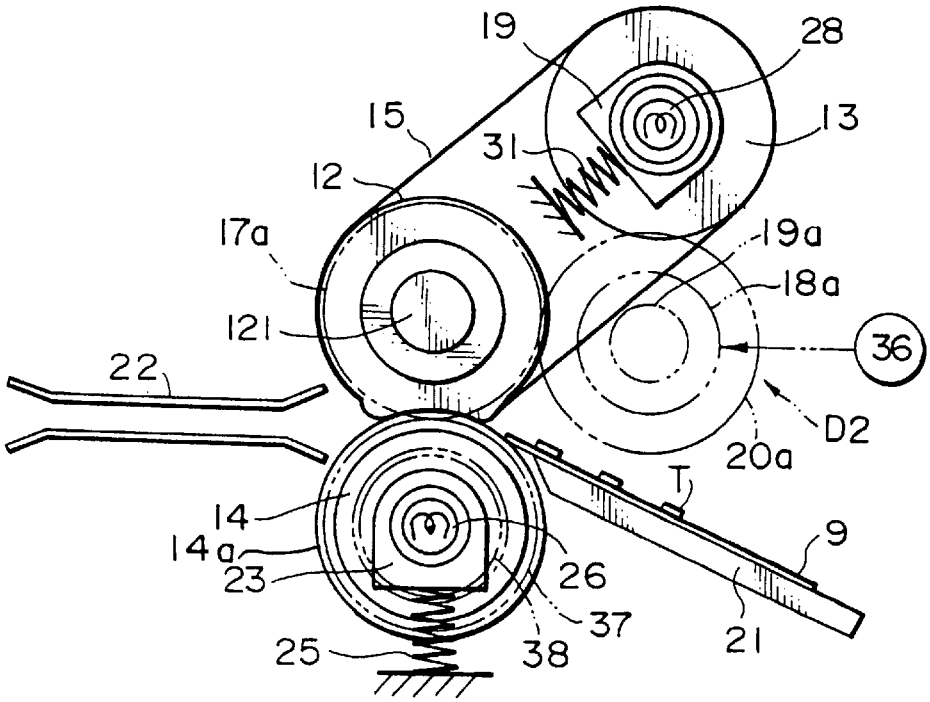
FIG. 8 is a side elevation showing another specific configuration of a driveline included in the illustrative embodiment.
Figure 9:
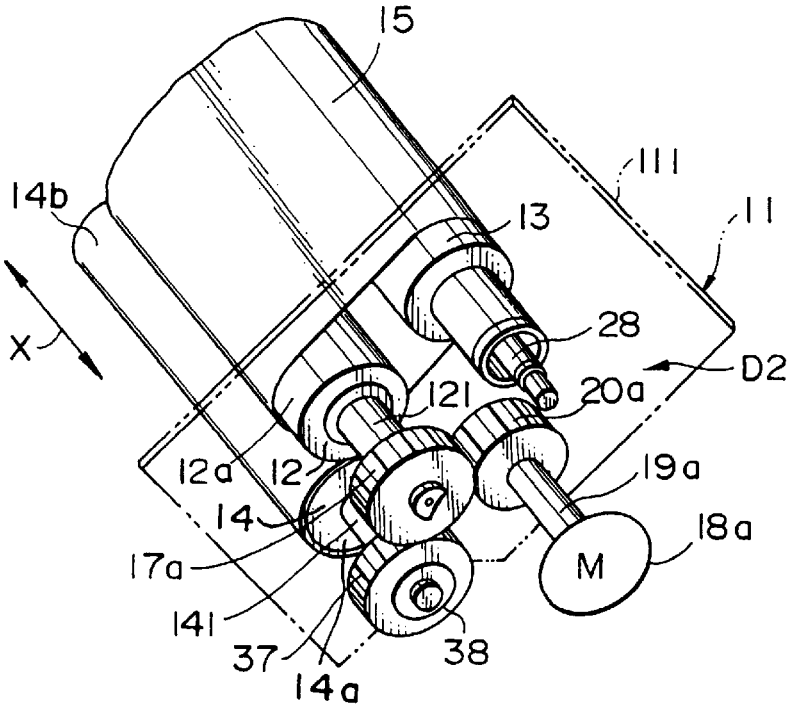
FIG. 9 is a fragmentary perspective view of the driveline shown in FIG. 8.

FIGS. 8 and 9 show a driveline D2 also including an input gear 17*a* mounted on one end of the shaft 121 of the fix roller 12. A drive gear 20*a* is held in mesh with the input gear 17*a*. A motor 18*a* is mounted on the end of a drive shaft 19*a* protruding from the drive gear 20*a*. A one-way clutch 38 and a driven gear 37 are mounted on the end of the shaft 141 of the press roller 14 outside of the portion of the shaft 141 facing the slider 23.

Specifically, the driven gear 37 is held in mesh with the input gear 17*a* and rotatable relative to the shaft 141. The one-way clutch 38 is made up of an inner part affixed to the shaft 141 and an outer part affixed to the driven gear 37. The one-way clutch 38 allows rotation to be transferred from the input gear 17*a* to the driven gear 37, but cuts the transfer of rotation from the driven gear 37 to the input gear 17*a*, thereby preventing the press roller 14 from slipping on the fix roller 12. The rollers 12 and 14 can therefore rotate in synchronism with each other.

With the driveline D2, it is possible to achieve the same advantages as with the driveline D1. Further, because the fix roller 12 and press roller 14 rotate in synchronism with each other, the belt 15 and roller 12 are free from deterioration ascribable to friction between then and the roller 14. In addition, the one-way clutch 38 absorbs a difference in peripheral speed between the belt 15 and the press roller 14 and thereby prevents the sheet 9 being conveyed from creasing or otherwise deforming.

Figure 10:
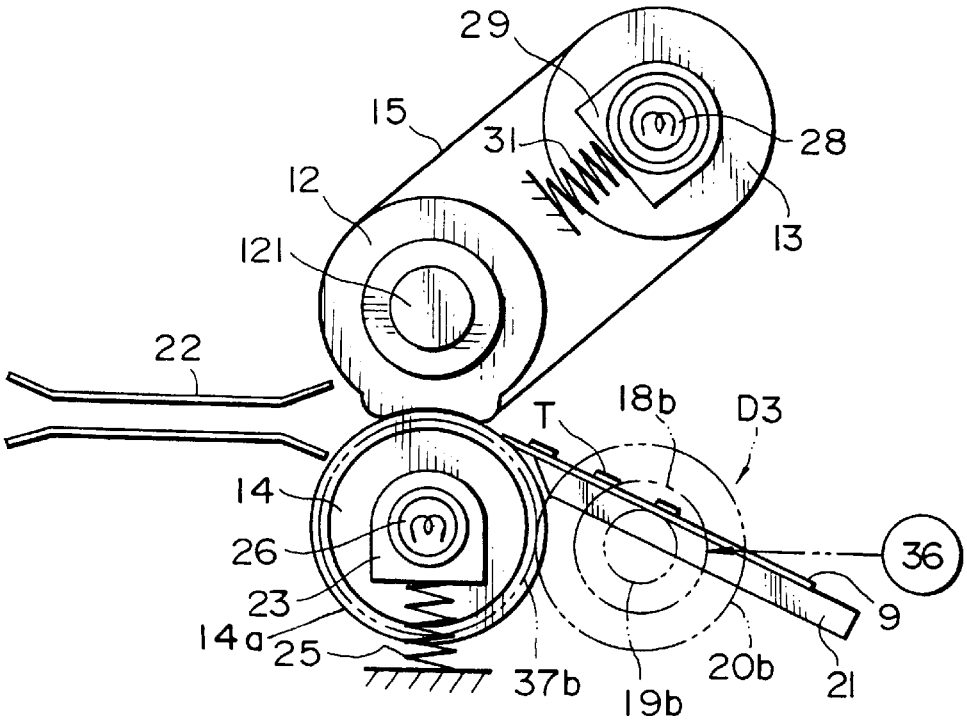
FIG. 10 is a side elevation showing another specific configuration of the driveline.
Figure 11:
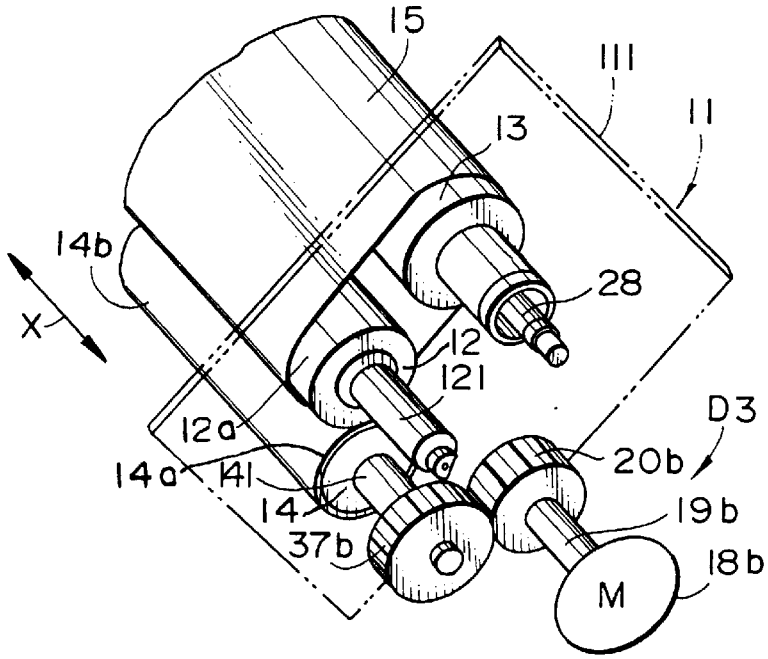
FIG. 11 is a fragmentary perspective view of the driveline shown in FIG. 10.

FIGS. 10 and 11 show a driveline D3. As shown, an input gear 37*b* is mounted on one end of the shaft 141 of the press roller 14. A drive gear 20*b* is held in mesh with the input gear 37*b*. A motor 18*b* is connected to the end of a drive shaft 19*b* protruding from the drive gear 20*b*.

Specifically, the above end of the shaft 141 is rotatably supported by the end plate 111 via a bearing not shown. The input gear 37*b* is mounted on the end of the shaft 141 outside of the end plate 111. A bracket, not shown, extends out from the outer surface of the end plate 111 and supports the drive shaft 19*b* via a bearing, not shown, and therefore the motor 18*b*. The rotation of the motor 18*b* is transferred to the press roller 14 via the drive gear 20*b* and input gear 37*b*. The press roller 14 causes the fix roller 12 to rotate via the belt 15. The press roller 14 has greater rigidity than the fix roller 12. Therefore, the press roller 14 directly receiving the output torque of the motor 18*b* causes the fix roller 12 to rotate via the belt 15. This reduces irregularity in the linear velocity at which the sheet 9 is conveyed in the direction Y, and thereby insures table conveyance of the sheet 9.

Figure 12:
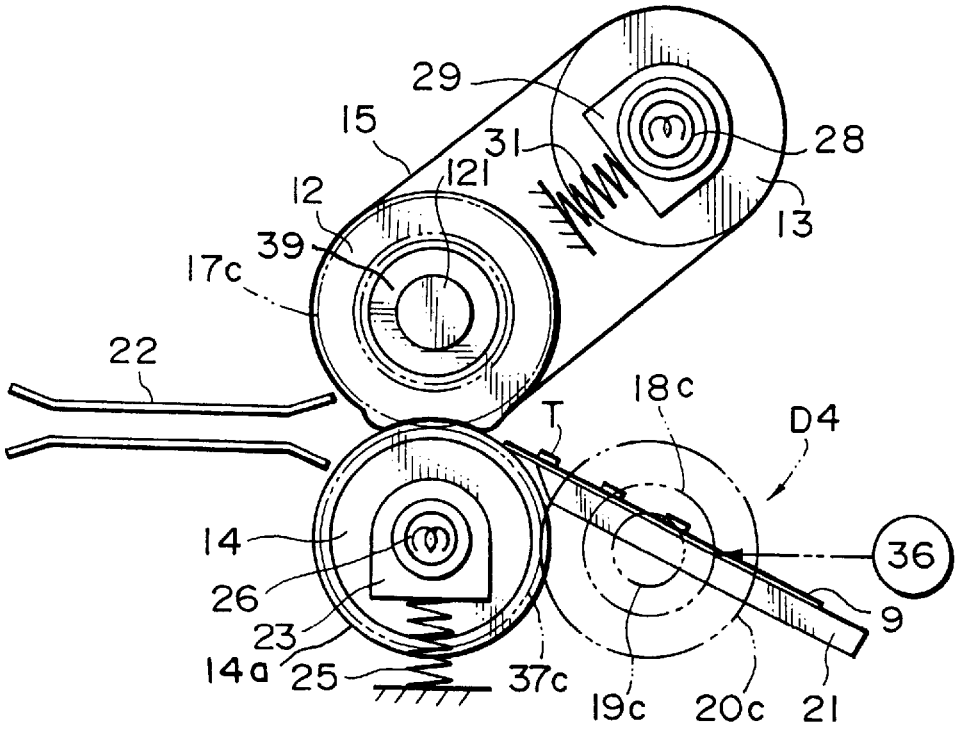
FIG. 12 is a side elevation showing another specific configuration of the driveline.
Figure 13:
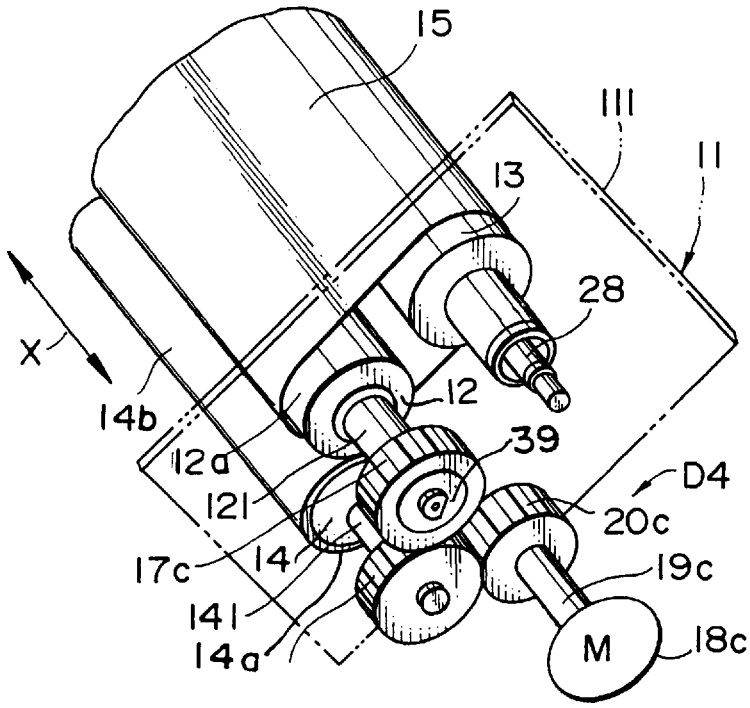
FIG. 13 is a perspective view of the driveline shown in FIG. 12.

FIGS. 12 and 13 show a driveline D4. As shown, the driveline D4, like the driveline D3, includes an input gear 37*c* mounted on one end of the shaft 141 of the press roller 14. A drive gear 20*c* is held in mesh with the input gear 37*c*. A motor 18*c* is connected to the end of a drive shaft 19*c* constructed integrally with the drive gear 20*c*. A one-way clutch 39 and a driven gear 17*c* are mounted on the end of the shaft 121 of the fix roller 12 outside of the portion of the shaft 121 facing the end plate 111.

Specifically, the driven gear 17*c* is held in mesh with the input gear 37*c* and rotatable relative to the shaft 121. The one-way clutch 39 has an inner part affixed to the shaft 121 and an outer part affixed to the driven gear 17*c*. The clutch 39 allows rotation to be transferred from the driven gear 17*c* to the fix roller 12, but cuts the transfer of rotation from the fix roller 12 to the driven gear 17*c*. This prevents the fix roller 12 from slipping on the press roller 14 and allows the two rollers 12 and 14 and belt 15 to rotate in synchronism with each other.

With the driveline 4, it is possible to achieve the same advantages as with the driveline D1. Particularly, the press roller 14 and belt 15 are prevented from slipping on each other. Therefore, the belt 15 and fix roller 12 are free from deterioration ascribable to friction otherwise acting between the belt 15 and fix roller 12 and the press roller 14. In addition, the one-way clutch 39 absorbs a difference in peripheral speed between the belt 15 and the press roller 14 and thereby prevents the sheet 9 being conveyed from creasing.

In the illustrative embodiment, the heaters 26 and 28 are respectively received in the press roller 14 and heat roller 13. Heat generated by the heaters 26 and 28 are transferred to the sheet 9 via the press roller 14, heat roller 13, and belt 15. If desired, the heater 28 of the press roller 14 may be omitted in order to simplify the construction, particularly in the modifications shown in FIGS. 8, 10 and 12. Further, the belt 15 may be configured to generate heat itself.

While the illustrative embodiment has been shown and described in relation to an electrophotographic color copier, the present invention is similarly applicable to any other image forming apparatus, e.g., a single-color copier or a printer.

In summary, it will be seen that the present invention provides a fixing device using a belt having various unprecedented advantages, as enumerated below.

(1) A nip has a width greater than 25° inclusive in terms of a circumferential angle as seen from the axis of a fix roller. Therefore, a relatively great nip width is formed by the belt and a press roller. Further, the fix roller and the belt passed over it form a small round shape at a position just downstream of the nip. The small round shape prevents a recording medium from wrapping around the belt, broadens the parting temperature range for fixation, and obviates toner offset. In addition, the fixing device needs only a small amount of parting agent or practically no parting agent and can be maintained by the user.

(2) The surface of the belt is covered with a parting agent. It follows that the recording medium moved away from the nip is surely separated from the belt without wrapping around the belt. In addition, the parting agent obviates toner offset more positively.

(3) The surface of the fix roller is covered with a sponge-like heat insulating material whose thickness is more than 17% of the diameter of the fix roller inclusive. The small round shape is therefore positively formed at the position just downstream of the nip which is the factor broadening the parting temperature range. In addition, a toque necessary for driving the fixing device is reduced.

(4) A heat source is not disposed in the fix roller. Therefore, even if the elastic material covering the fix roller is relatively thick, the warm-up time is prevented from increasing.

(5) The sponge-like heat insulating material covering the fix roller has hardness of less than 30° inclusive in terms of Ascar hardness. This forms the small round shape more positively and thereby further reduces its diameter. It follows that the recording medium is more surely prevented from wrapping around the belt, and the required torque and therefore the size of a motor is reduced.

(6) The press roller has a surface layer implemented by an elastic material as thin as 2 mm or less and as hard as 40° or above in accordance with JISA. The press roller is therefore more rigid than the fix roller, rendering the nip upwardly convex. This is successful to prevent the recording medium from wrapping around the belt more positively.

(7) The press roller is covered with a material having a high parting ability, preventing the recording medium from wrapping around the press roller.

(8) A drive force for driving the belt is applied to the fix roller, so that the conveyance of the recording medium is stable.

(9) The drive force is applied to the press roller via a one-way clutch, driving both of the press roller and belt. The press roller and belt are therefore prevented from slipping on each other, so that the belt and fix roller are free from deterioration ascribable to friction. Further, a one-way clutch absorbs a difference in peripheral speed between the belt and the press roller and thereby preventing the recording medium from creasing or otherwise deforming.

(10) The drive force is applied to the press roller. This, coupled with the fact that the press roller is more rigid than the fix roller, irregularity in the linear velocity for conveying the recording medium is reduced. This further stabilizes the conveyance of the recording medium.

(11) The drive force is applied to the fix roller via a one-way clutch, driving both of the press roller and belt. The press roller and belt are therefore prevented from slipping on each other, so that the belt and fix roller are free from deterioration ascribable to friction. Further, a one-way clutch absorbs a difference in peripheral speed between the belt and the press roller and thereby prevents the recording medium from creasing or otherwise deforming.

Various modifications will become possible for those skilled in the art after receiving the teachings of the present disclosure without departing from the scope thereof.

What is claimed is:

1. A fixing device for fixing a toner image formed on a recording medium, comprising:

a fix roller having a surface layer covered with a sponge-like heat insulating material having a thickness which is more than 17% of a diameter of said fix roller inclusive;

an endless belt passed over a plurality of rollers including the fix roller;

a press roller pressed against a portion of said belt passed over the fix roller; and a heat source for applying heat to the toner image carried on the recording medium being conveyed via a nip where said belt and said press roller are pressed against each other;

said nip having a width greater than 25° inclusive in terms of a circumferential angle as seen from an axis of said fix roller.

2. A fixing device as claimed in claim 1, wherein a surface of said belt is covered with a parting agent.

3. A fixing device as claimed in claim 2, wherein said heat source is located at a position other than an inside of said fix roller.

4. A fixing device as claimed in claim 3, wherein said sponge-like heat insulating material has a hardness of less than 30° inclusive in terms of Ascar hardness.

5. A fixing device as claimed in claim 4, wherein said press roller has a surface layer formed of an elastic material and less than 2 mm thick inclusive and having a hardness of higher than 40° inclusive.

6. A fixing device as claimed in claim 5, wherein said surface layer of said press roller is covered with a material having a high parting ability.

7. A fixing device as claimed in claim 6, wherein a drive force for driving said belt is applied to said fix roller.

8. A fixing device as claimed in claim 7, wherein the drive force is applied to said press roller via a one-way clutch.

9. A fixing device as claimed in claim 1, wherein said heat source is located at a position other than an inside of said fix roller.

10. A fixing device as claimed in claim 9, wherein said sponge-like heat insulating material has a hardness of less than 30° inclusive in terms of Ascar hardness.

11. A fixing device as claimed in claim 10, wherein said press roller has a surface layer formed of an elastic material and less than 2 mm thick inclusive and having a hardness of higher than 40° inclusive.

12. A fixing device as claimed in claim 11, wherein said surface layer of said press roller is covered with a material having a high parting ability.

13. A fixing device as claimed in claim 12, wherein a drive force for driving said belt is applied to said fix roller.

14. A fixing device as claimed in claim 13, wherein the drive force is applied to said press roller via a one-way clutch.

15. A fixing device as claimed in claim 1, wherein said heat source is located at a position other than an inside of said fix roller.

16. A fixing device as claimed in claim 1, wherein said sponge-like heat insulating material has a hardness of less than 30° inclusive in terms of Ascar hardness.

17. A fixing device as claimed in claim 16, wherein said press roller has a surface layer formed of an elastic material and less than 2 mm thick inclusive and having a hardness of higher than 40° inclusive.

18. A fixing device as claimed in claim 17, wherein said surface layer of said press roller is covered with a material having a high parting ability.

19. A fixing device as claimed in claim 18, wherein a drive force for driving said belt is applied to said fix roller.

20. A fixing device as claimed in claim 19, wherein the drive force is applied to said press roller via a one-way clutch.

21. A fixing device as claimed in claim 1, wherein said press roller has a surface layer formed of an elastic material and less than 2 mm thick inclusive and having a hardness of higher than 40° inclusive.

22. A fixing device as claimed in claim 21, wherein said surface layer of said press roller is covered with a material having a high parting ability.

23. A fixing device as claimed in claim 22, wherein a drive force for driving said belt is applied to said fix roller.

24. A fixing device as claimed in claim 23, wherein the drive force is applied to said press roller via a one-way clutch.

25. A fixing device as claimed in claim 1, wherein a surface layer of said press roller is covered with a material having a high parting ability.

26. A fixing device as claimed in claim 25, wherein a drive force for driving said belt is applied to said fix roller.

27. A fixing device as claimed in claim 26, wherein the drive force is applied to said press roller via a one-way clutch.

28. A fixing device as claimed in claim 1, wherein a drive force for driving said belt is applied to said fix roller.

29. A fixing device as claimed in claim 28, wherein the drive force is applied to said press roller via a one-way clutch.

30. A fixing device as claimed in claim 1, wherein a drive force is applied to said press roller.

31. A fixing device as claimed in claim 30, wherein the drive force is applied to said fix roller via a one-way clutch.

* * * * *

US006091926C1

(12) EX PARTE REEXAMINATION CERTIFICATE (5351st)

United States Patent
Yamada

(10) Number: US 6,091,926 C1
(45) Certificate Issued: Apr. 18, 2006

(54) FIXING DEVICE USING A BELT FOR AN IMAGE FORMING APPARATUS

(75) Inventor: Masamichi Yamada, Kanagawa (JP)

(73) Assignee: Ricoh Company, Ltd., Tokyo (JP)

Reexamination Request:
No. 90/006,895, Dec. 23, 2003

Reexamination Certificate for:
Patent No.: 6,091,926
Issued: Jul. 18, 2000
Appl. No.: 09/277,222
Filed: Mar. 26, 1999

(30) Foreign Application Priority Data

Mar. 27, 1998 (JP) ..... 10-081693

(51) Int. Cl.
*G03G 15/20* (2006.01)

(52) U.S. Cl. ..... 399/329; 399/75; 399/333
(58) Field of Classification Search ..... 219/216; 347/156; 399/75, 320, 324, 328, 329, 333
See application file for complete search history.

(56) References Cited

U.S. PATENT DOCUMENTS 5,471,288 A * 11/1995 Ohtsuka et al. ..... 399/338
5,581,340 A * 12/1996 Hayashi et al. ..... 399/328
5,890,047 A * 3/1999 Moser ..... 399/329
5,926,680 A * 7/1999 Yamamoto et al. ..... 399/328

FOREIGN PATENT DOCUMENTS

| | | |
|---|---|---|
| JP | 59-044631 | * 10/1984 |
| JP | 04-050883 | * 2/1992 |
| JP | 6-258976 | 9/1994 |
| JP | 6-318001 | 11/1994 |

* cited by examiner

*Primary Examiner*—Hoang Ngo

(57) ABSTRACT

A fixing device for fixing a toner image formed on a recording medium includes an endless belt passed over a plurality of rollers. A press roller is pressed against a portion of the belt passed over a fix roller, which is one of the plurality of rollers. A heat source applies heat to the toner image carried on the recording medium being conveyed via a nip where the belt and press roller are pressed against each other. The nip has a width greater than 25° inclusive in terms of a circumferential angle as seen from the axis of the fix roller. The fixing device prevents a recording medium from wrapping around the belt and broadens a parting temperature range.

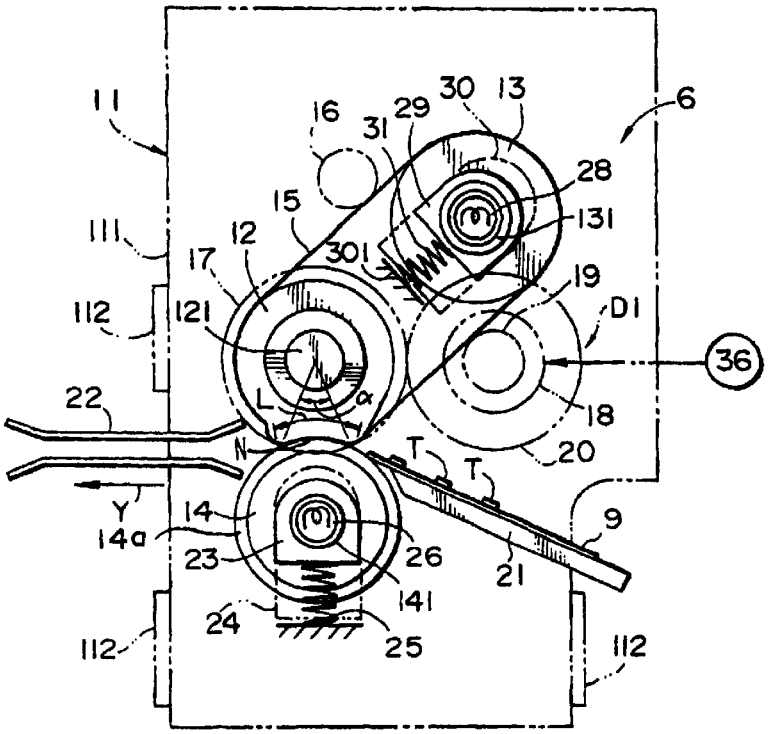

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–31 is confirmed.

New claim 32 is added and determined to be patentable.

*32. A fixing device as claimed in 1, wherein said nip is convex relative to the fix roller.*

* * * * *